US005732447A

United States Patent [19]

Nolen et al.

[11] Patent Number: 5,732,447

[45] Date of Patent: Mar. 31, 1998

[54] BUTTON FASTENER

[76] Inventors: Ronald L. Nolen, deceased, late of West Frankfort, Ill.; by Gloria J. Nolen, executor, 10999 Avery Rd., West Frankfort, Ill. 62896; by Doris J. Nolen Wilce, executor, Rte. 2, Box 91, Thompsonville, Ill. 62890; by Laura S. Nolen Hubbard, executor, 605 Vaux St., Zeigler, Ill. 62999; Tracy L. Nolen, 10999 Avery Rd., West Frankfort, Ill. 62896, heir of said Ronald L. Nolen, deceased

[21] Appl. No.: 746,444

[22] Filed: Nov. 8, 1996

[51] Int. Cl.[6] ..... A44B 1/00; B25F 1/00

[52] U.S. Cl. ..... 24/40; 24/429

[58] Field of Search ..... 24/40, 41, 45, 24/429, 419, 546, 455; 7/123, 169

[56] References Cited

U.S. PATENT DOCUMENTS

| | | | |
|---|---|---|---|
| 218,570 | 8/1879 | Platt | 24/40 |
| 277,181 | 5/1883 | Witsil | 24/40 |
| 349,415 | 9/1886 | Taylor | 24/40 |
| 361,151 | 4/1887 | Fallis | 24/40 |
| 438,044 | 10/1890 | Williams | 24/40 |
| 473,035 | 4/1892 | Patten | 24/40 |
| 1,084,399 | 1/1914 | Collins | 24/40 |
| 1,245,545 | 11/1917 | Sarkisian | 24/40 X |
| 2,912,733 | 11/1959 | Layman | 24/40 |
| 3,683,459 | 8/1972 | Johansen | 24/40 |
| 4,942,646 | 7/1990 | Sebastian | 24/40 |
| 4,997,222 | 3/1991 | Reed | 24/429 X |
| 5,347,688 | 9/1994 | Ross | 24/40 |

FOREIGN PATENT DOCUMENTS

| | | | |
|---|---|---|---|
| 12190 | 8/1906 | United Kingdom | 24/40 |

*Primary Examiner*—Peter M. Cuomo
*Assistant Examiner*—Robert J. Sandy
*Attorney, Agent, or Firm*—Edward H. Renner

[57] ABSTRACT

A device is provided that facilitates the buttoning and unbuttoning, as well as the zipping and unzipping, of clothing for individuals with limited manual dexterity. The device has an insertion portion at one end for sliding into a buttonhole, a buttoner portion at the other end in the form of a hook and an unbuttoner portion therebetween.

17 Claims, 3 Drawing Sheets

BUTTON FASTENER

FIELD OF THE INVENTION

This invention relates to the field of fasteners for clothing. More particularly, this invention enables an individual with hand muscular difficulties to button and unbutton as well as to zip and unzip clothing.

BACKGROUND OF THE INVENTION

This invention involves a button hooker and unhooker that can also be used to zip and unzip zippers. The device is easy to manipulate, durable and compact.

Conventional button hookers are difficult for the individual with manual dexterity problems. Individuals with arthritis, for example, often find conventional button hookers to still require a level of dexterity which the individual does not possess.

There exists button hookers consisting basically of a loop into which a button is inserted. With these devices, the button hooker is passed through the button hole, looped around the button, then the device and button are pulled back through the button hole. These button hookers are not capable of also unbuttoning clothing.

There are prior art zipper aids consisting basically of an extended hook or U-shaped portion. However, these devices are not useful for buttons. Most pants, for example, that have zippers, also have at least one button.

Individuals with limited hand dexterity may desire the freedom to both button and unbutton clothing without requiring another individual's help. A device allowing an arthritic individual to unbutton and unzip her jeans then to zip and button them back is very useful.

It might be possible to carry a device that buttons clothing, one that unbuttons clothing and one that zips zippers, but this would be cumbersome and expensive.

The present invention overcomes these and other disadvantages in a manner not revealed in the known prior art.

Applicants are aware of the following U.S. patents, the disclosures of which are incorporated by reference herein:

U.S. Pat. No. 5,347,688
U.S. Pat. No. 4,997,222
U.S. Pat. No. 4,942,646
U.S. Pat. No. 3,683,459
U.S. Pat. No. 639,442
U.S. Pat. No. 438,044
U.S. Pat. No. 368,024
U.S. Pat. No. 349,415
U.S. Pat. No. 322,284
U.S. Pat. No. 277,181

SUMMARY OF THE INVENTION

This invention provides a fastener, particularly a button hooker, that is capable of buttoning and unbuttoning buttons and of zipping and unzipping zippers.

The device of this invention may be a unitary implement having a hook on one end that can be inserted through a button hole and hooked around the perimeter of a button to allow the button to be pulled through the button hole, thereby closing the button and button hole. This hook may also be used to zip and unzip zippers by inserting the hook through the pull tab provided on zippers.

The device may have an elongate end that is substantially straight for insertion into a button hole when a button is to be unfastened. This straight portion provides leverage and opens the button hole when the unbuttoner portion is hooked around the button and rotated to unbutton it.

The device of the invention may also have an unbuttoner portion provided between the buttoner portion and the insertion portion. The unbuttoner portion may be somewhat S-shaped and bent so the button can be held within the unbuttoner portion. The unbuttoner portion holds the button and provides leverage to force the button through the button hole when the device of the invention is rotated.

It is an object of this invention to provide a button hooker that can be used by individuals with arthritis, Parkinsons, cerebral palsy and other afflictions affecting manual dexterity.

It is a further object of this invention to provide a button hooker that is small enough to be easily carried by the individual and to provide one that is light weight.

It is another object of this invention to provide a button hooker that can be manufactured easily and inexpensively.

This invention can be used by an individual with a minimum amount of exertion and effort.

The button hooker of this invention allows individuals with limited hand and or finger dexterity to regain an independence which may have been lost or never experienced.

It is an object of this invention to provide a button hooker that works efficiently on clothing, even tight fitting apparel such as jeans and denim.

It is an object of this invention to provide a button hooker that can be used by right handed or left handed individuals.

It is a further object of this invention to provide a button hooker that can be easily manufactured in various sizes to accommodate varying articles of clothing such as jackets, shirts, pants, vests and sweaters.

It is also an object of this invention to provide a button hooker that can be easily retrieved, for example, from a flat surface because it is not completely planar and thus allows an individual to pick it up.

It is an object of this invention to provide a device for unfastening a button hole and a button comprising opposed ends, an insertion portion at one of the ends, and an unbuttoner portion having a generally S-shaped configuration.

It is a further object of this invention to provide that the unbuttoner portion is disposed between the opposed ends.

It is also an object of this invention to provide a buttoner portion at the other of the ends.

It is an object of this invention to provide a buttoner portion capable of zipping and unzipping zippers and to provide that the buttoner portion is a hook.

It is a further object of this invention to provide that the unbuttoner portion includes a first and second bend, the bends being nonplanar relative to each other.

It is an additional object of this invention to provide that the unbuttoner portion includes a first, second and middle portion, the first and middle portions being planar and the second and middle portions being planar.

It is an object of this invention to provide that the first, second and third portions are nonplanar in combination.

It is a further object of this invention to provide that the unbuttoner portion includes a first, second and middle portion, the second and middle portions being placed on top of the button for unfastening.

It is an additional object of this invention to provide that the first portion is placed under the button for unfastening.

It is an object of this invention to provide that the insertion portion opens the buttonhole as the device is rotated.

It is an object of this invention to provide that the second and middle portions urge the button through the button hole as the device is rotated.

It is an object of this invention to provide a method of unbuttoning a button hole and a button including the steps of inserting an insertion portion of a device into the button hole, sliding an unbuttoner portion of the device around the button, rotating the device until the button is unfastened, and removing the insertion portion of the device from the button hole.

It is also an object of this invention to provide the further step of unzipping a zipper with a buttoner portion of the device.

It is a further object of this invention to provide the step of zipping the zipper with the buttoner portion of the device.

It is an object of this invention to provide a method of unbuttoning and buttoning a button hole and a button including the steps of inserting an insertion portion of a device into the button hole, sliding an unbuttoner portion of the device around the button, rotating the device until the button is unfastened, removing the insertion portion of the device from the button hole, inserting a buttoner portion into the button hole, looping the buttoner portion around the button, and pulling the button through the button hole with the buttoner portion.

The button hooker of the invention is inexpensive to manufacture, simple to use and efficient in operation. Further understanding of the invention may be obtained by reference to the drawings and the description of embodiments included herein.

DESCRIPTION OF THE PREFERRED EMBODIMENTS

Figure 1:
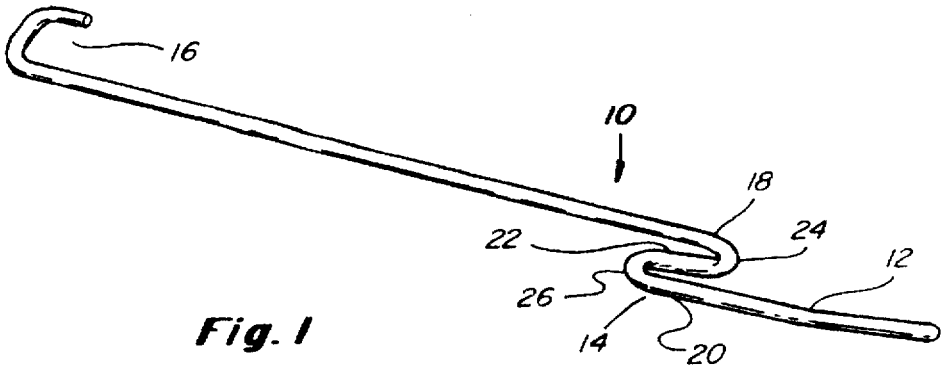
FIG. 1 is a perspective view of the invention.

Referring now by reference numerals to the drawings and first to FIG. 1, it will be understood that the fastener device 10, or button hooker, includes an insertion portion 12, an unbuttoner portion 14 and a buttoner portion 16.

The device 10 can be used for fastening or unfastening a button B through a button hole H. Additionally, the buttoner portion 16 of the device 10 can be used to zip and unzip zippers Z.

Figure 2:
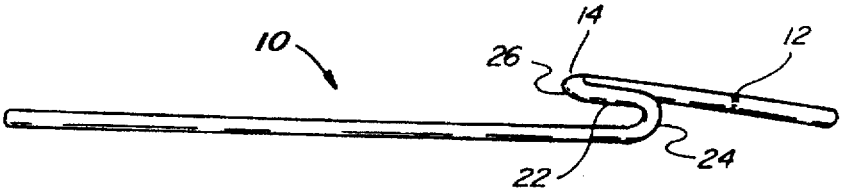
FIG. 2 is a perspective view of an alternative embodiment.

The device 10 shown in FIGS. 1–2 is of a unitary construction, preferably made from a strong material that does not break or splinter with constant use. It is preferably cylindrical, but could be flat or multi-faceted about its perimeter.

Figure 3:
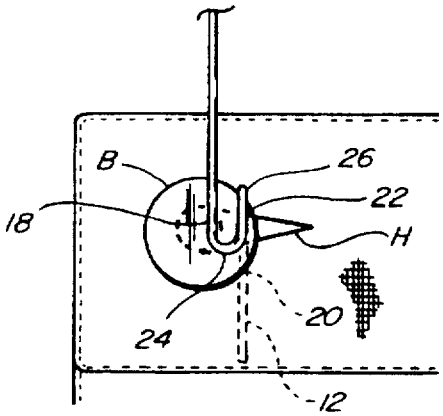
FIG. 3 is a fragmentary front elevational view of the invention illustrating its operation in unbuttoning a button.

The device 10 of the invention has an elongate insertion portion 12 located at one of its two ends. As seen in FIG. 3, the insertion portion 12 is inserted into a buttonhole H to begin the process of unbuttoning a button B.

The device 10 has a buttoner portion 16 disposed at the other of its two ends, as shown in FIG. 1. If it is not desired to have the capability of buttoning and/or zipping the invention, the device 10 could be configured as shown in FIG. 2 without buttoner portion 16. Instead, the other end of device 10 could merely be an elongate portion similar to the insertion portion 12.

As seen in FIGS. 1 and 2, there is an unbuttoner portion 14 disposed between the two ends of the device 10. The unbuttoner portion 14 is generally S-shaped having a first portion 18, a second portion 20 and a middle portion 22. The first and second portions 18, 20 extend and merge into the buttoner portion 16 and insertion portioner 12, respectfully. The unbuttoner portion 14 has two bends 24, 26, the first bend 24 formed from first portion 18 and middle portion 22 and the second bend 26 formed from middle portion 22 and second portion 20.

As seen in FIG. 2 the unbuttoner portion 14 is bent about middle portion 22 in such a manner that first bend 24 and second bend 26 are not planar with respect to each other. This bent S-shaped configuration allows the user to slide one of the two portions 18, 20 behind button B while the other of the two portions 18, 20 is positioned on top of button B thereby trapping the button B within the unbuttoner portion 14, as shown in FIG. 3.

Figure 4:
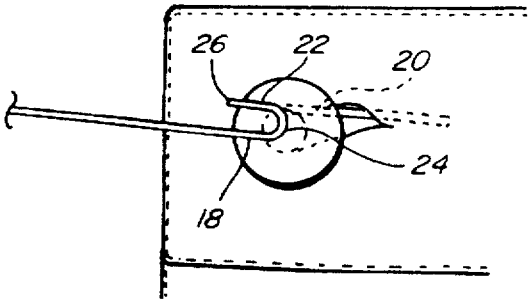
FIG. 4 is a fragmentary front elevational view of the invention illustrating its operation in unbuttoning a button.

For illustrative purposes, the process of using the device 10 of the invention for unbuttoning, unzipping, then zipping and buttoning a pair of jeans will be described. To begin the process, the insertion portion 12 is inserted into the button hole H along side the button B, as shown in FIG. 3. The insertion portion 12 is pointed generally downwards. The unbuttoner portion 14 is then positioned around the button B, as shown in FIGS. 3 and 4. The second portion 20 of the unbuttoner portion 14 is placed behind the button B and the middle portion 22 and first portion 18 of the unbuttoner portion 14 are placed on top of the button B. It can be seen that the second bend 26 is generally beside the button B and the first bend 24 is on top of the button B.

Figure 5:
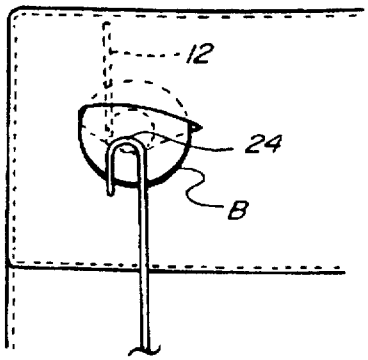
FIG. 5 is a fragmentary front elevational view of the invention illustrating its operation in unbuttoning a button.
Figure 6:
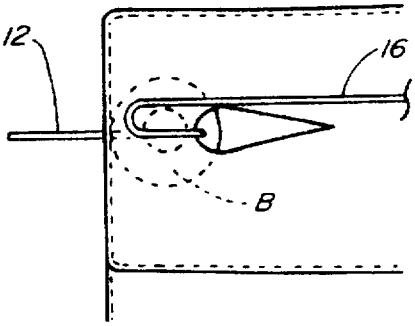
FIG. 6 is a fragmentary front elevational view of the invention illustrating its operation in unbuttoning a button.

Once the unbuttoner portion 14 of the device 10 is positioned around the button B, the device is pivoted about the button B area by using the unbuttoner portion 16 as a handle and rotating it downwardly and slightly outwardly away from the wearer's jeans, as shown in FIGS. 4 and 5. This action applies pressure from the first bend portion 24 to the top of button B and pushes the button B through the button hole H. Once the device 10 has been rotated approximately 270°; the button B is unbuttoned from the button hole H. By rotating the unbuttoner portion 16, the combination of opposed pressure from pushing on top of the button B by first portion 18 and middle portion 22 and pulling upwards on button B by second portion 20 slides one edge of the button B through the button hole H, then the rest of button B follows. FIGS. 3–6 illustrate the unbuttoning of button B from insertion of the insertion portion 12 into the button hole H in FIG. 3; to rotation of the device 10 opening the button hole H in FIG. 4; to further rotation of the device 10 sliding the button B through the button hole H in FIG. 5; then to completion of the unbuttoning of the button B in FIG. 6.

Figure 7:
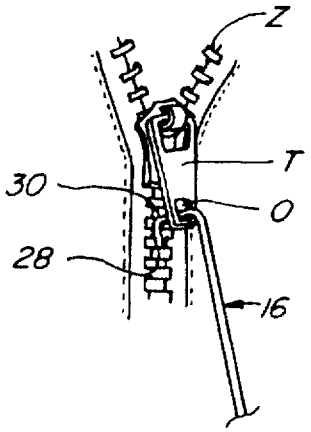
FIG. 7 is a fragmentary front elevational view of the invention illustrating its operation in unzipping a zipper.

Once the button B has been unbuttoned, the wearer hooks the buttoner portion 16 of the device 10 on the zipper Z and pulls downwardly on the zipper. As can be seen in FIG. 7, end 28 of the buttoner portion 16 is inserted through the opening O of zipper pull tab T. The tab T is hooked by buttoner bend 30 allowing the wearer to pull downwardly on the device 10 by using the insertion portion 12 (not shown) as a handle to unzip the zipper Z. The device 10 is then removed from the zipper pull tab T.

Figure 8:
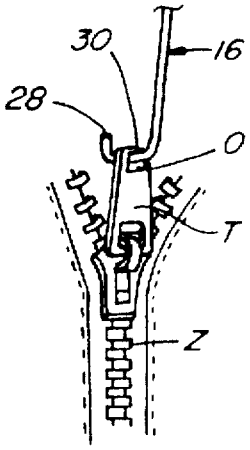
FIG. 8 is a fragmentary front elevational view of the invention illustrating its operation in zipping a zipper.

The wearer can zip her jeans by reversing the process. As seen in FIG. 8, end 28 of the buttoner portion 16 is hooked upwardly through the opening O of the zipper pull tab T. The zipper pull tab T is hooked by buttoner bend 30 and with an upwardly motion of the device 10, again using insertion portion 12 as a handle, the zipper Z is rezipped.

Figure 9:
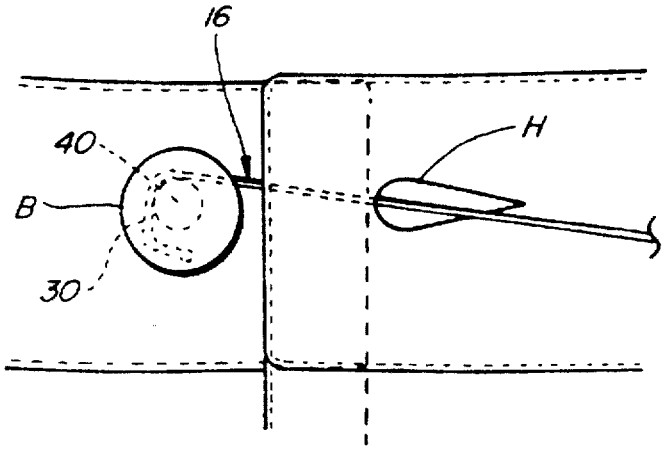
FIG. 9 is a fragmentary front elevational view of the invention illustrating its operation in buttoning a button.
Figure 10:
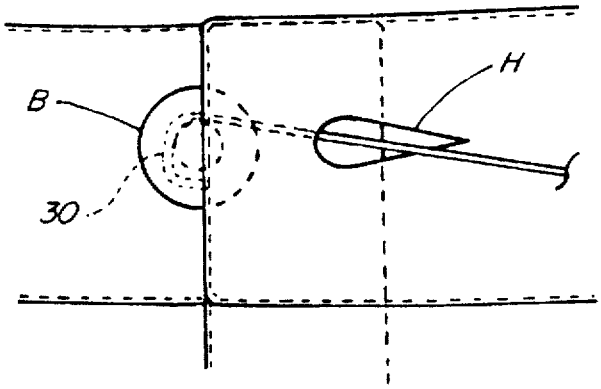
FIG. 10 is a fragmentary front elevational view of the invention illustrating its operation in buttoning a button.
Figure 11:
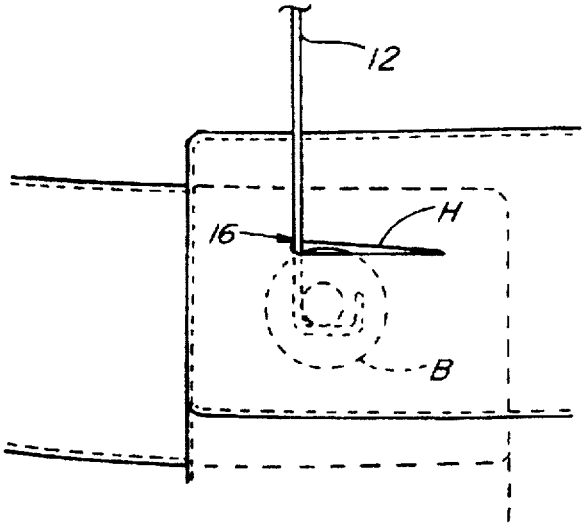
FIG. 11 is a fragmentary front elevational view of the invention illustrating its operation in buttoning a button.
Figure 12:
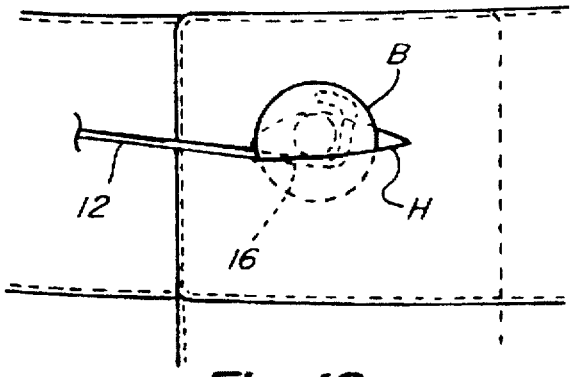
FIG. 12 is a fragmentary front elevational view of the invention illustrating its operation in buttoning a button.
Figure 13:
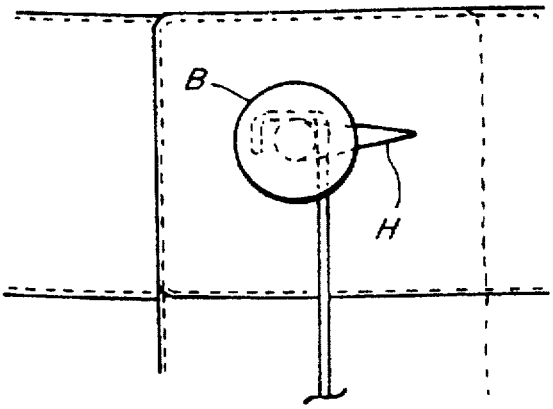
FIG. 13 is a fragmentary front elevational view of the invention illustrating its operation in buttoning a button.

To button the button B through the button hole H, the wearer inserts the buttoner portion 16 through button hole H, as shown in FIG. 9. The buttoner bend 30 is then looped around the back of button B and hooked on to the button attachment portion 40. The button attachment portion 40 is the area of attachment between the wearer's clothing and the button B. Then, as shown in FIG. 9, the wearer pulls the button B toward the button hole H by pulling on the device 10, using the insertion portion 12 as a handle. The buttoner portion 16 and button B are brought through the button hole H by rotating the device 10, using the insertion portion 12 as a handle, as the button B is pulled toward the button hole H, as shown in FIGS. 10–12. The upward lift of the device 10 as it is rotated opens the button hole H allowing the button B to slide through. As the rotation continues, the buttoner bend 30 is pulled, along with button B, through the hole H until the button B is fastened, as shown in FIG. 13.

The device 10 may be constructed of various lengths and widths. The device 10 may be approximately 5 inches in length and 1/16 of an inch to 1/8 of an inch wide. The buttoner portion may be approximately one half inch from the first bend 24 to the second bend 26. The insertion portion 12 may be approximately 1 and ½ inches from the end to second bend 26. The buttoner portion 16 may be approximately 4 inches from the buttoner bend 30 to the first bend 24. A hook between ¼ inch to ½ inch should suffice for buttoning a button and zipping and unzipping zippers. It will be understood that the device 10 could be of almost any size.

The device 10 can be used equally well by left or right handed individuals. Also, it can be rotated in the reverse direction of that shown. It will also be understood that the invention can be used on buttons located on either the right or left side of clothing.

The device 10 has been described as if the wearer were buttoning, unzipping, zipping, then buttoning a pair of jeans. It will be understood that any combination of buttoning, unbuttoning, zipping and unzipping could be performed. Furthermore, different size buttons can be unbuttoned more easily by varying the size of the unbuttoner portion 14.

All of the invention has been described by making detailed reference to preferred embodiments. Such detail should be understood by those skilled in the art as instructive rather than in any restrictive sense. Many other variants are possible within the scope of the claims hereunto appended. The invention is not to be limited to the specifics as shown here for purposes of illustration but only by the scope of the appended claims and their equivalents.

It is claimed:

1. A device for unfastening a button hole and a button comprising:

(a) an elongated member having opposed first and second ends;

(b) an elongated insertion portion provided at a first one of said ends;

(c) an unbuttoner portion provided adjacent to the insertion portion, the unbuttoner portion having a generally S-shaped configuration; and (d) the unbuttoner portion having first and second bends spaced longitudinally inward from the elongated insertion portion, said bends being nonplanar relative to each other, the first and second bends providing cooperating means for pressing a button downwardly through a button hole.

2. The device of claim 1, further comprising:

(e) a buttoner portion provided at the other of said ends.

3. The device of claim 2, in which:

(f) the buttoner portion is capable of zipping and unzipping zippers.

4. The device of claim 3, in which:

(g) the buttoner portion is a hook.

5. The device of claim 4, in which:

(h) the hook includes a buttoner bend for pulling the button through the button hole.

6. The device of claim 1, in which:

(d) the unbuttoner portion includes a first, second and middle portion, said first and middle portions being planar and said second and middle portions being planar.

7. The device of claim 6, in which:

(e) said first and second portions are nonplanar.

8. The device of claim 1, in which:

(d) the unbuttoner portion includes a first, second and middle portion, said first and middle portions being placed on top of the button for unfastening.

9. The device of claim 8, in which:

(e) said second portion is placed under the button for unfastening.

10. The device of claim 9, in which:

(f) said first and middle portions urge the button through the button hole as the device is rotated.

11. The device of claim 1, in which:

(d) said insertion portion urges the button hole open as the device is rotated.

12. A method of unbuttoning a button hole and a button including the steps:

(a) inserting an elongated insertion portion of an unbuttoner device into the button hole, the device having an intermediate unbuttoner portion spaced inwardly from the insertion portion, the unbuttoner portion having first an second bends;

(b) sliding the first bend of the unbuttoner portion of the device around the button;

(c) rotating the device and pressing the second bend against the button forcing the button inwardly until the button is unfastened; and (d) removing the insertion portion of the device from the button hole.

13. The method of claim 12, further comprising the step:

(e) unzipping a zipper with a buttoner portion of the device.

14. The method of claim 13, further comprising the step:

(f) zipping the zipper with the buttoner portion of the device.

15. A method of unbuttoning and buttoning a button hole and a button including the steps:

(a) inserting an insertion portion of the device into the button hole;

(b) sliding an unbuttoner portion of the device around the button, the unbuttoner portion having first and second bends;

(c) rotating the device and pressing a bend of the unbuttoner portion against the top of the button to force the button downwardly through the button hole until the button is unfastened;

(d) removing the insertion portion of the device from the button hole;

(e) inserting a buttoner portion into the button hole;

(f) looping the buttoner portion around the button; and (g) rotating the device while pulling the button through the button hole with the buttoner portion.

16. The device of claim 1 wherein the second bend provides means for positioning around the button and the first bend provides means for positioning on top of the button, the first and second bends cooperating to press a button downwardly through a button hole on rotation of the device.

17. The device of claim 1 wherein the insertion portion provides means for applying leverage to the button hole on rotation of the device.

* * * * *